US005953695A

United States Patent [19]

Barazesh et al.

[11] Patent Number: 5,953,695

[45] Date of Patent: Sep. 14, 1999

[54] METHOD AND APPARATUS FOR SYNCHRONIZING DIGITAL SPEECH COMMUNICATIONS

[75] Inventors: Bahman Barazesh, Marlboro; San Hyok Yon, Keasbey, both of N.J.

[73] Assignee: Lucent Technologies Inc., Murray Hill, N.J.

[21] Appl. No.: 08/959,888

[22] Filed: Oct. 29, 1997

[51] Int. Cl.[6] ..... G10L 3/02; G10L 9/00

[52] U.S. Cl. ..... 704/201; 704/219

[58] Field of Search ..... 704/201, 219, 704/220, 221, 224, 229

[56] References Cited

U.S. PATENT DOCUMENTS

| | | | |
|---|---|---|---|
| 4,965,748 | 10/1990 | Chang et al. | 364/519 |
| 5,206,932 | 4/1993 | Chang et al. | 395/165 |
| 5,717,822 | 2/1998 | Chen | 704/219 |
| 5,778,338 | 7/1998 | Jacobs et al. | 704/201 |

*Primary Examiner*—Susan Wieland

[57] ABSTRACT

A digital speech communication system having improved synchronization. The present digital speech communication system reduces the unit of degradation to a single speech sample, rather than a multi-sample frame, while maintaining the bit rate efficiency of the DSVD system and other systems where speech is encoded into large blocks and is subject to variable delay and mismatched clocks. The basic unit that is dropped or artificially inserted by the receiver, if the buffer overflows or empties, respectively, is reduced to a single speech sample. The speech frames produced by the demultiplexer are written into a frame buffer, in units of frames, at a rate determined by the clock signal, S2, that is extracted from the received signal by a timing recovery function in the modem. In accordance with the present invention, the frames are read out of the buffer into the decoder using the same extracted clock signal, S2. In this manner, once the buffer is partially full, the frame buffer will not overflow or empty. The speech decoder converts the coded speech into blocks of speech samples. The blocks of speech samples are then written to a variable frame buffer, in accordance with the extracted clock signal, S2. The variable frame buffer is allowed to partially fill, before the speech samples are read out to the digital-to-analog converter according to a clock signal, S3, at the 8 kHz sample rate, for presentation to the listener. When the variable frame buffer overflows, only a single speech sample needs to be discarded rather than an entire frame of multiple samples. Likewise, when the variable frame buffer empties, only a single extraneous speech sample need be inserted. The number of samples in the variable frame buffer will preferably be kept within predefined tolerances by a write process and a read process.

21 Claims, 7 Drawing Sheets

METHOD AND APPARATUS FOR SYNCHRONIZING DIGITAL SPEECH COMMUNICATIONS

Standard for DSVDs, or the Intel DSVD standard, each commercially available from Lucent Technologies Inc., Rockwell, 3COM and other modem manufacturers. A DSVD permits simultaneous voice and data communications between a pair of users on a voiceband circuit. Speech signals are sampled at a nominal rate of 8 kHz, under control of a clock signal, S1, and converted to a digital signal by means of an analog-to-digital converter 110. A voice encoder 120, also under control of clock signal S1, applies an audio compression algorithm to reduce the bit rate of the signal, in a known manner. The voice encoder 120 outputs frames of voice data, for example, 10 msec frames each consisting of 80 speech samples.

As shown in FIG. 1A, the frames produced by the encoder 120 are packet-multiplexed by a multiplexer 130 with variable length customer data, to produce blocks of variable length packets. The data is clocked by a clock signal, S2, which may be asynchronous with S1. In addition, the multiplexer 130 and modem 140 are clocked by the clock signal, S2. The analog signal produced by the modem 140 is then transmitted to the receiver, shown in FIG. 1B. The transmitted signal will exhibit jitter, or variable delay, due to the variability of the multiplexed data packet length, as well as due to lost speech packets. Since the speech signal has been encoded and transmitted by the transmitter 100 as frames of data, the jitter will occur in multiples of the frame length.

FIG. 1B illustrates a receiver 145 for a conventional DSVD system. Upon receipt of a signal from the transmitter 100, the composite voice/data signal is demodulated by the modem 150 and the encoded speech and customer data are separated by the demultiplexer 160. The modem 150 and the demultiplexer 160 are clocked by a clock signal that is extracted from the received signal by a timing recovery function in the modem 150, so that the frequency agrees with the clock signal, S2, used to transmit the signal. The extracted speech signal is processed by a speech section 200, discussed further below in conjunction with FIG. 2. Generally, the speech section 200 includes a decoder 170 to decoded the encoded speech, for presentation to the listener under control of a clock signal, S3, generated by the receiver 145. The clock signal, S1, used by the transmitter 100 to read in voice data and encode the speech typically differs from the frequency of the corresponding clock signal, S3, in the receiver 145. In current DSVD systems, the clock signals, S1 and S3, may differ from each other by up to 0.01%.

FIG. 2 illustrates the speech section 200 of current DSVD receivers. As shown in FIG. 2, the speech frames produced by the demultiplexer 160 (FIG. 1B) are written into a variable length buffer 210, in units of frames, at a rate determined by the clock signal, S2, that is extracted from the received signal by a timing recovery function in the modem 150. Thereafter, the frames are read out of the buffer into the decoder 170 by the local clock, S3. Thus, the buffer 210 may overflow or empty, depending on the difference between the two clock rates, S2 and S3. The speech decoder 170 converts the coded speech into blocks of speech samples, again in units of the coded speech frame. The blocks of speech samples are then read out according to a clock signal, S3, at the 8 kHz sample rate into a digital-to-analog converter 180, for presentation to the listener, in a known manner.

In order to accommodate the two different clock rates, S2 and S3, a number of frames are initially allowed to accumulate in the buffer 210. During the frame accumulation period, the decoder generates a silent signal. Once a predefined number of frames have been placed in the buffer 210, the decoder then becomes operative, provided the buffer 210 does not overflow or empty. If the buffer overflows, speech frames are dropped. If the buffer empties, an extraneous frame, such as the last received frame, must be inserted, typically with some attenuation. In this system, the variable delay, and the length of dropped or extraneous speech segments, are frames consisting of 80 speech samples.

As apparent from the above-described deficiencies with conventional systems for synchronizing digital speech communications, a need exists for a digital speech communication system that reduces the unit of degradation to a single sample, rather than large blocks of such samples, while still providing the bit rate efficiency of an advanced speech coding scheme. A further need exists for a digital speech communication system that reduces the basic unit that is dropped or artificially inserted by the receiver if the buffer overflows or empties, respectively.

SUMMARY OF THE INVENTION

Generally, a digital speech communication system having improved synchronization is disclosed. The present digital speech communication system reduces the unit of degradation to a single speech sample, rather than a multi-sample frame, while maintaining the bit rate efficiency of the DSVD system and other systems where speech is encoded into large blocks and is subject to variable delay and mismatched clocks. According to one aspect of the invention, the basic unit that is dropped or artificially inserted by the receiver if the buffer overflows or empties, respectively, is reduced to a single speech sample.

The speech frames produced by the demultiplexer are written into a frame buffer, in units of frames, at a rate determined by the clock signal, S2, that is extracted from the received signal by a timing recovery function in the modem. In accordance with the present invention, the frames are read out of the buffer into the decoder using the same extracted clock signal, S2. In this manner, once the buffer is partially full, the frame buffer will not overflow or empty. The speech decoder converts the coded speech into blocks of speech samples. The blocks of speech samples are then written to a variable frame buffer, in accordance with the extracted clock signal, S2. The variable frame buffer is allowed to partially fill, before the speech samples are read out to the digital-to-analog converter according to a clock signal, S3, at the 8 kHz sample rate, for presentation to the listener.

When the variable frame buffer overflows, only a single speech sample needs to be discarded rather than an entire frame of multiple samples. Likewise, when the variable frame buffer empties, only a single extraneous speech sample need be inserted. The number of samples in the variable frame buffer will preferably be kept within predefined tolerances by a write process and a read process.

A more complete understanding of the present invention, as well as further features and advantages of the present invention, will be obtained by reference to the following detailed description and drawings.

DETAILED DESCRIPTION

Figure 1A:
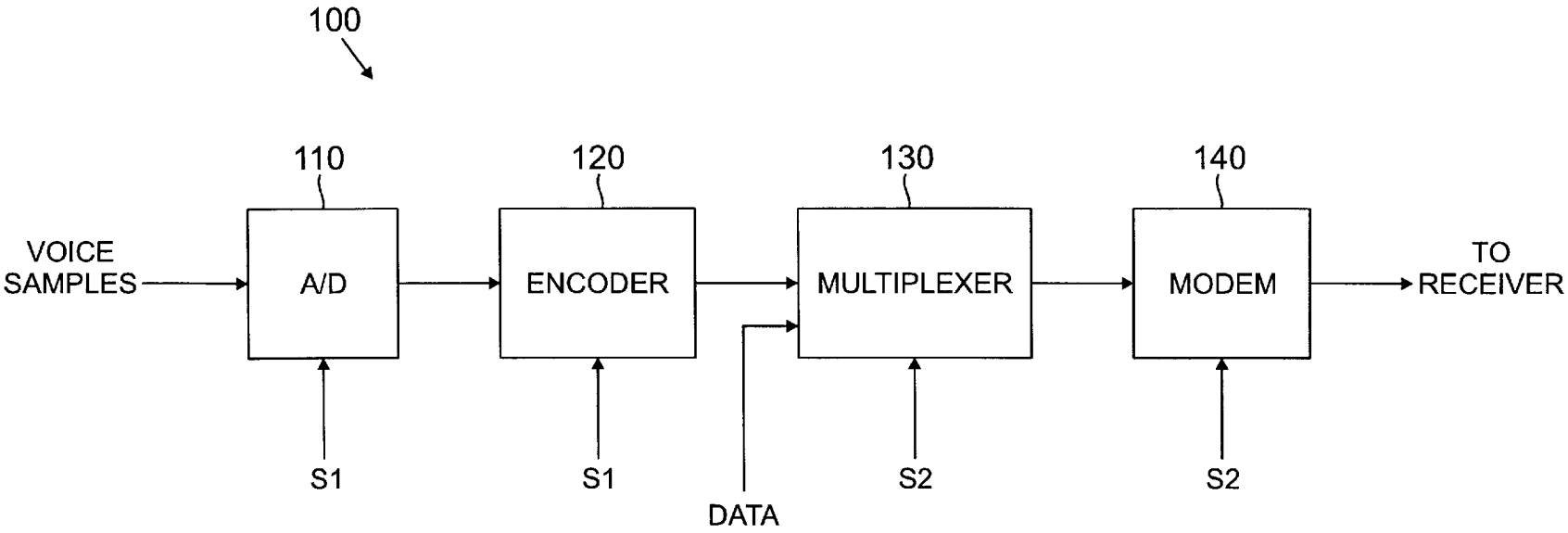
FIG. 1A PRIOR ART
FIG. 1A is a schematic block diagram of a conventional transmitter of a DSVD system.
Figure 1B:
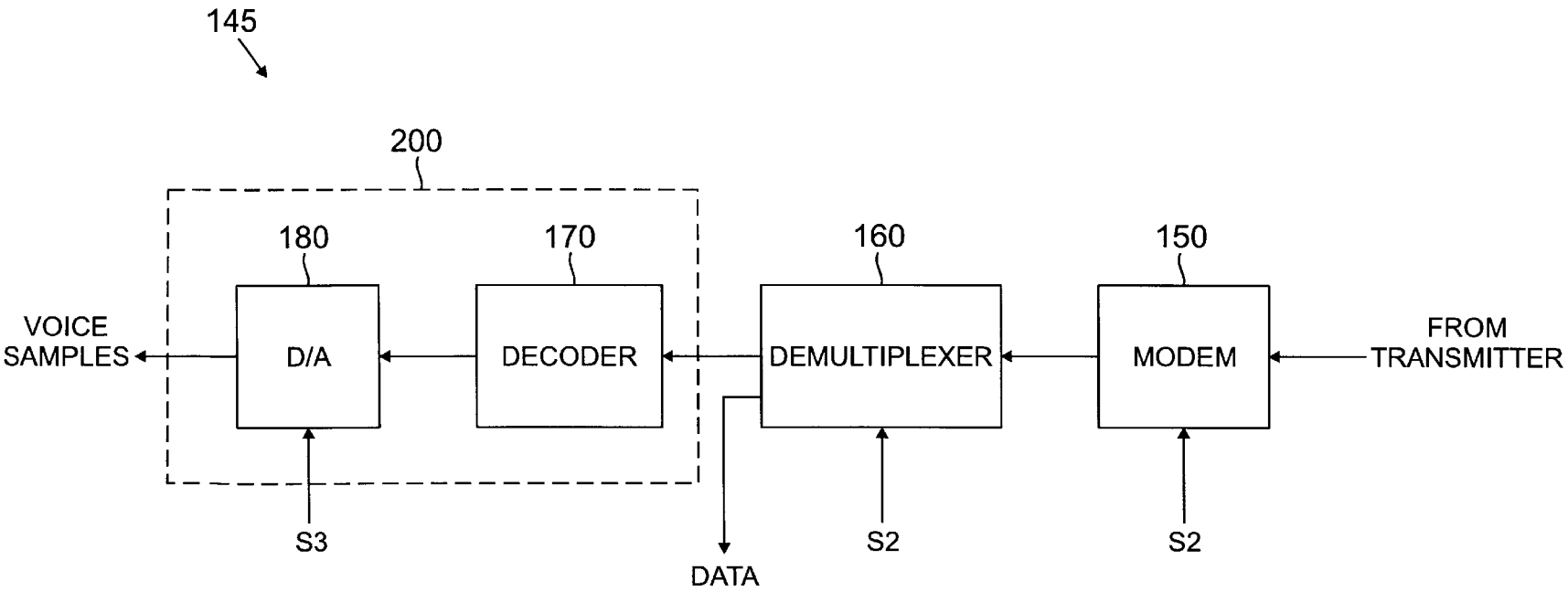
FIG. 1B PRIOR ART
FIG. 1B is a schematic block diagram of a conventional receiver of a DSVD system.
Figure 2:
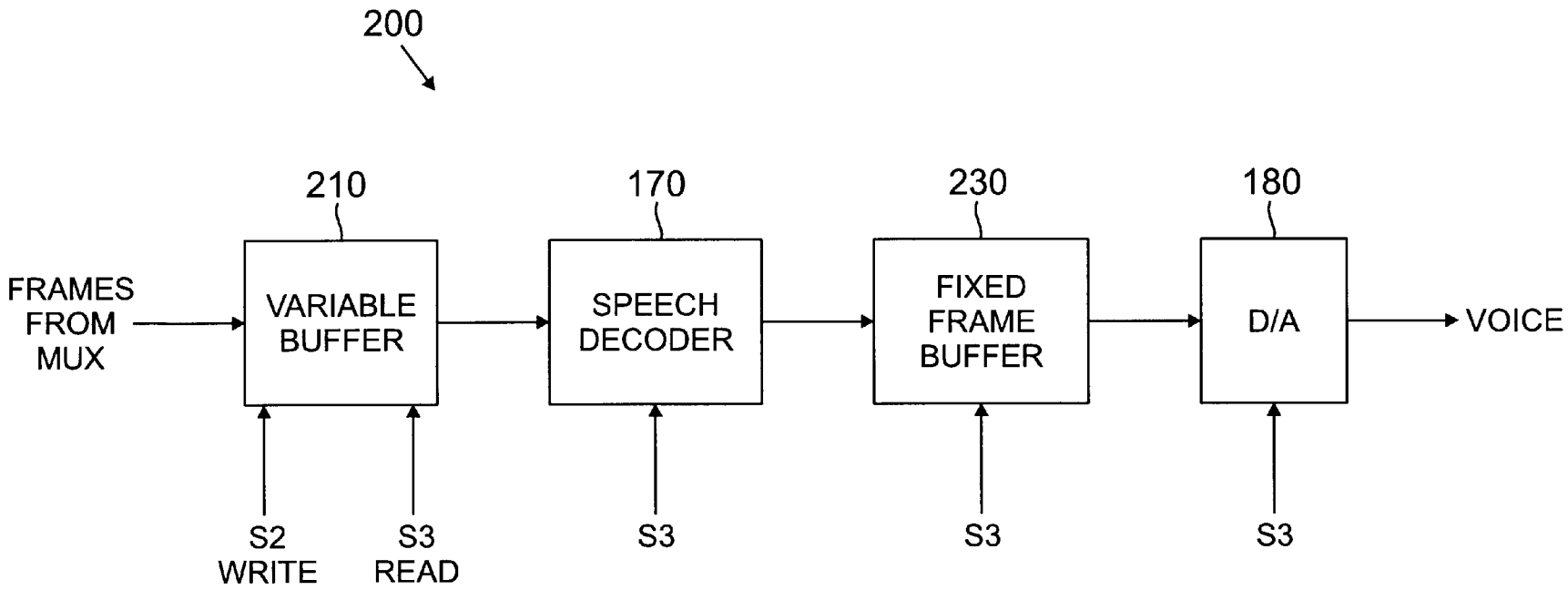
FIG. 2 PRIOR ART
FIG. 2 is a schematic block diagram of a conventional speech section of the receiver of FIG. 1B.
Figure 3:
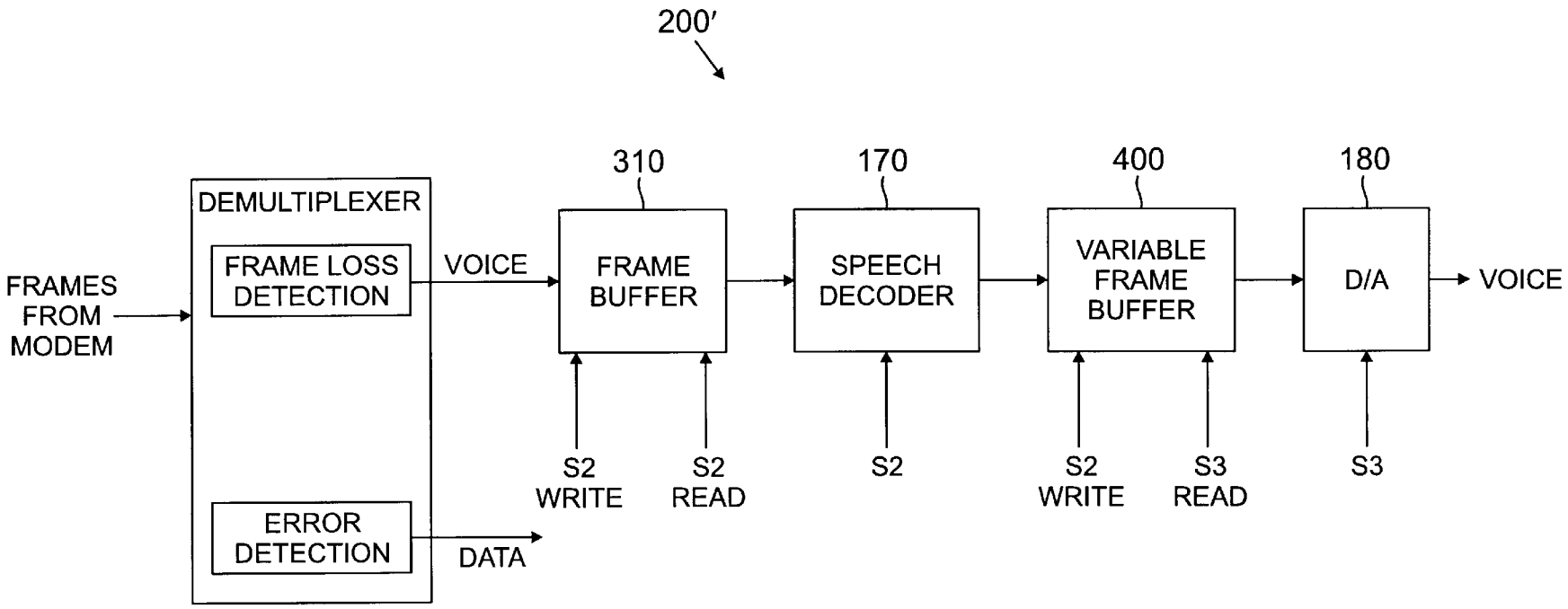
FIG. 3 is a schematic block diagram of a speech section for the receiver of FIG. 1B, in accordance with the present invention.

As discussed above, FIGS. 1A and 1B illustrate a conventional transmitter 100 and receiver 145, respectively, of a DSVD system. In accordance with a feature of the present invention, the speech section 200 of the receiver 145 shown in FIG. 1B is modified as shown in FIG. 3, to achieve improved synchronization for digital speech communications. As discussed below, the speech section 200' shown in FIG. 3 reduces the unit of degradation to a single speech sample, rather than a multi-sample frame, while maintaining the bit rate efficiency of the DSVD system described above in conjunction with FIGS. 1 and 2. Specifically, the speech section 200' shown in FIG. 3 reduces the basic unit that is dropped or artificially inserted by the receiver 145 if the buffer overflows or empties, respectively, to a single speech sample.

As shown in FIG. 3, the speech frames produced by the demultiplexer 160 (FIG. 1B) are written into a frame buffer 310, in units of frames, at a rate determined by the clock signal, S2, that is extracted from the received signal by a timing recovery function in the modem 150. As shown in FIG. 3, the demultiplexer includes means for correction for "frame erasures" (lost frames or frames received erroneously). Thus, if a speech frame is received with errors, the demultiplexer 160 will write only a frame header, indicating an erroneous frame, to the speech decoder 170. If a speech frame is lost due to line errors, the demultiplexer 160 shall detect the non-reception of a speech frame by means of a local timer that indicates the maximum inter-frame delay, and write a frame header, indicating an erroneous frame, to the speech decoder 170.

Figure 4:
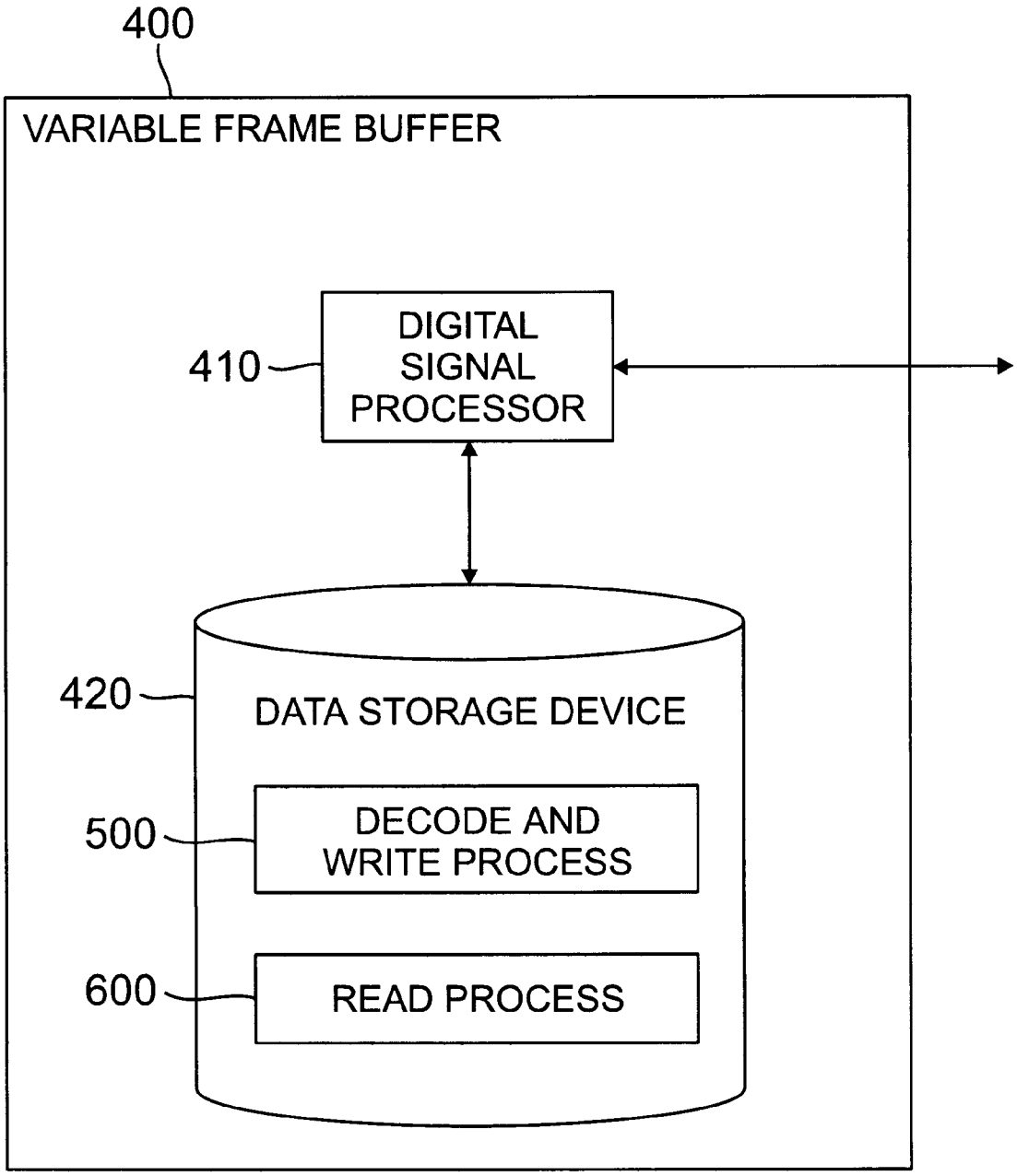
FIG. 4 is a schematic block diagram of the variable frame buffer of FIG. 3.

In accordance with the present invention, the frames are read out of the buffer into the decoder 170 using the same extracted clock signal, S2. In this manner, once the buffer 310 is partially full, the frame buffer 310 will not overflow or empty. The speech decoder 170 converts the coded speech into blocks of speech samples. The blocks of speech samples are then written to a variable frame buffer 400, discussed further below in conjunction with FIG. 4, in accordance with the extracted clock signal, S2. The variable frame buffer 400 is allowed to partially fill, before the speech samples are read out to the digital-to-analog converter 180 according to a clock signal, S3, at the 8 kHz sample rate, for presentation to the listener.

Thus, when the variable frame buffer 400 overflows, only a single speech sample needs to be discarded rather than an entire frame of multiple samples. Likewise, when the variable frame buffer 400 empties, only a single extraneous speech sample need be inserted. As discussed further below, the number of samples in the variable frame buffer 400 will preferably be kept within predefined tolerances by a decode and write process 500 and a read process 600.

The variable frame buffer 400, as well as the other components in the speech section 200' shown in FIG. 3, may be embodied as a digital signal processor (DSP) or in circuitry, as would be apparent to a person of ordinary skill. In the illustrative implementation, shown in FIG. 4, the variable frame buffer 400 is embodied as a digital signal processor 410. As shown in FIG. 1B, the digital signal processor 410, which may be embodied as a single processor or a number of processors operating in parallel, is preferably configured to implement the program code, discussed below in conjunction with FIGS. 5 and 6, associated with the present invention which may be stored in a data storage device 420. The data storage device 420 preferably stores the program code for the variable frame buffer 400, including a decode and decode and write process 500 and a read process 600, discussed below in conjunction with FIGS. 5 and 6, respectively.

Figure 5:
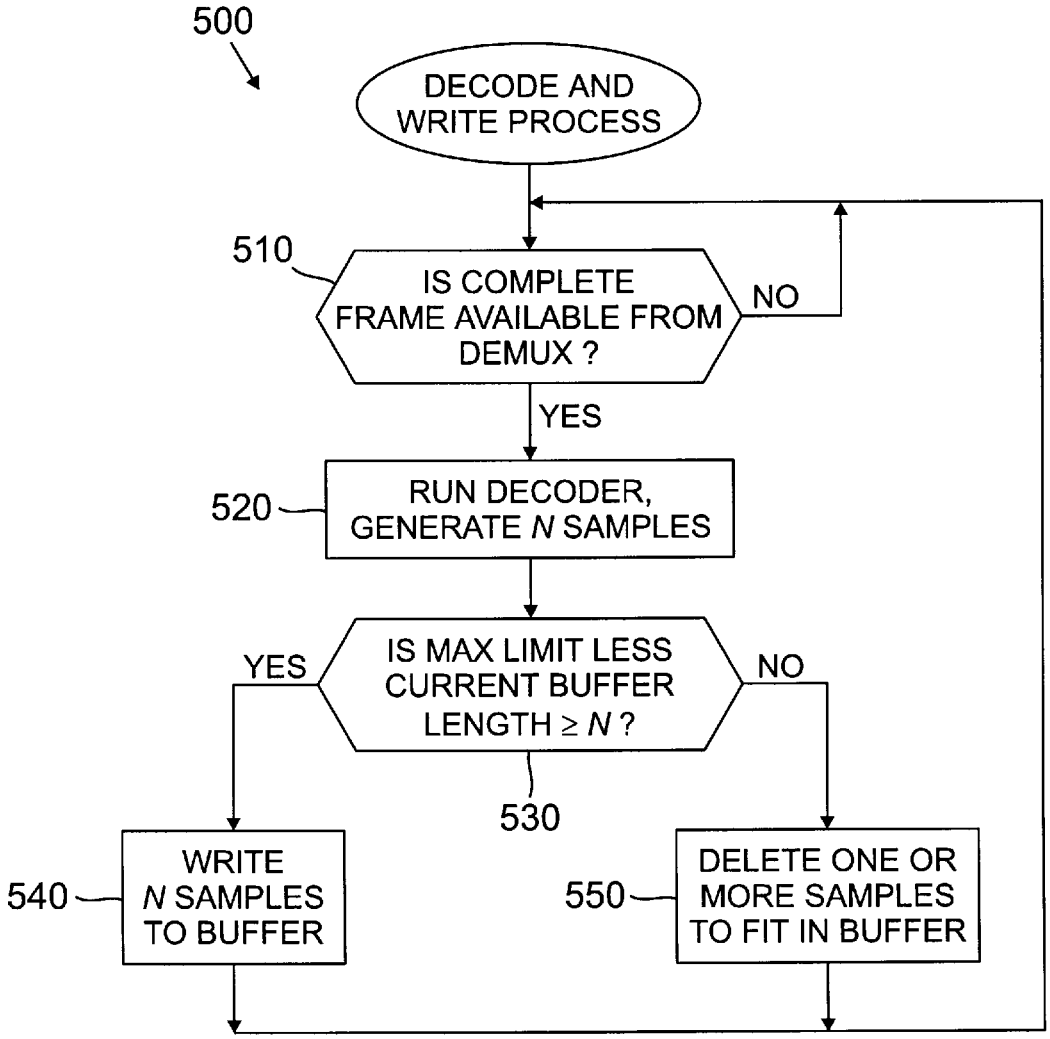
FIG. 5 is a flow chart describing an exemplary write process implemented by the variable frame buffer of FIG. 4.

The variable frame buffer 400 implements the decode and write process 500, shown in FIG. 5, to write the blocks of speech samples produced by the decoder 170 to the buffer memory, and to ensure that the buffer memory does not overflow. As shown in FIG. 5, the decode and write process 500 initially performs a test during step 510 to determine if there is a complete frame available from the demultiplexer 160. If it is determined during step 510 that there is not a complete frame available from the demultiplexer 160, then program control returns to step 510 to await a complete frame. If, however, it is determined during step 510 that there is a complete frame available from the demultiplexer 160, then the decoder is executed during step 520, and N samples are generated. Thereafter, a test is performed during step 530 to determine if the maximum buffer limit, less the current buffer utilization is greater than or equal to N. In other words, the test performed during step 530 determines if writing the N generated samples to the buffer will exceed the buffer capacity. If it is determined during step 530 that writing the N generated samples to the buffer will not exceed the buffer capacity, then the N samples are written to the buffer during step 540. If, however, it is determined during step 530 that writing the N generated samples to the buffer will exceed the buffer capacity, then one or more samples are first deleted from the buffer during step 550, to fit the current N samples. Thereafter, program control returns to step 510 to continue processing in the manner described above.

Figure 6:
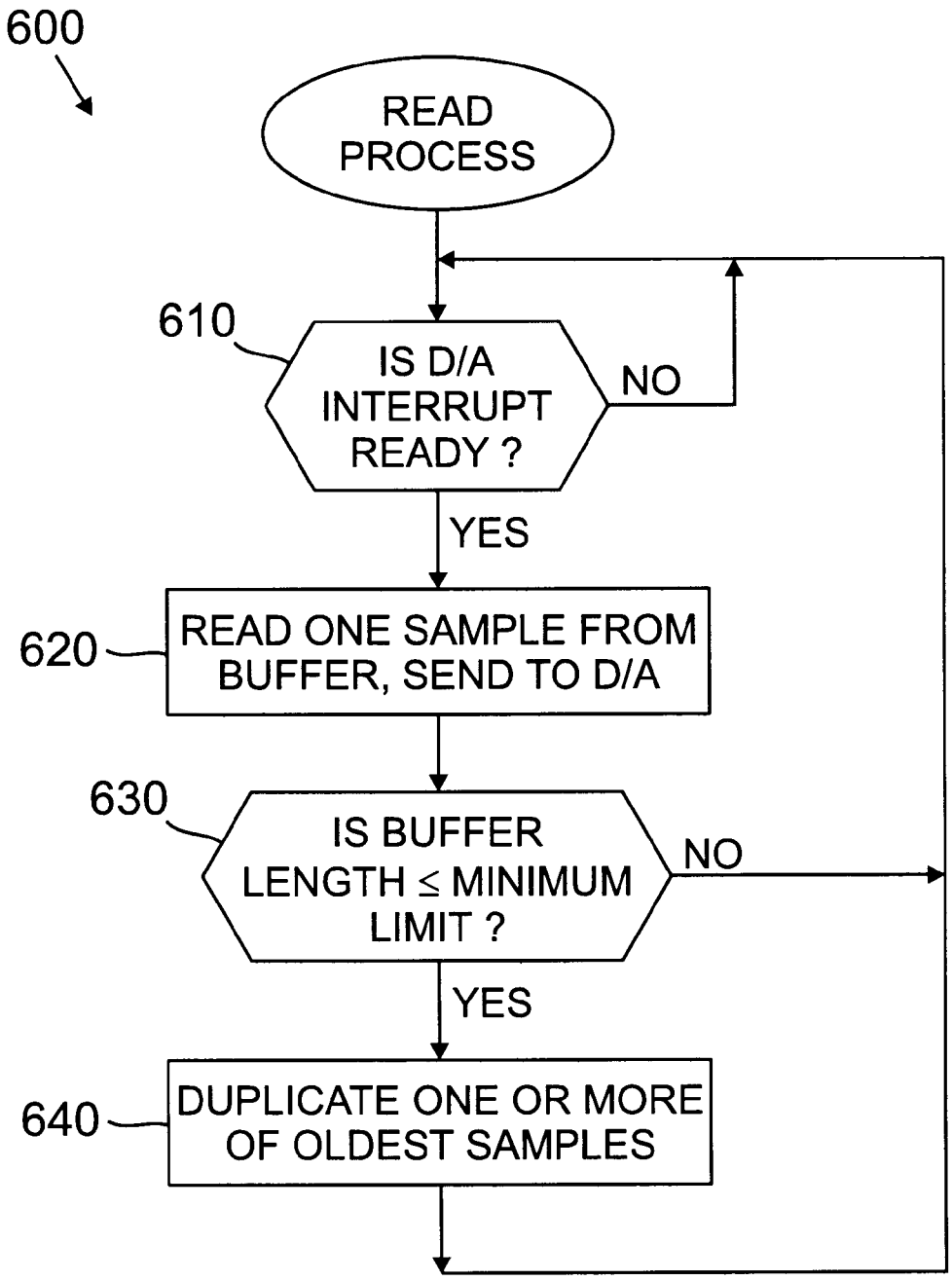
FIG. 6 is a flow chart describing an exemplary read process implemented by the variable frame buffer of FIG. 4.

The variable frame buffer 400 implements the read process 600, shown in FIG. 6, to read the speech samples stored in the buffer memory, and to ensure that the buffer memory does not empty. As shown in FIG. 6, the read process 600 initially performs a test during step 610 to determine if the interrupt of the digital-to-analog converter 180 is ready. If it is determined during step 610 that the interrupt of the digital-to-analog converter 180 is not ready, then program control returns to step 610 to wait for the interrupt. If, however, it is determined during step 610 that the interrupt of the digital-to-analog converter 180 is ready, then one sample is read from the buffer during step 620, and is sent to the digital-to-analog converter 180.

A further test is then performed during step 630 to determine if the current buffer length is less than or equal to the minimum limit. If it is determined during step 630 that the current buffer length is not less than or equal to the minimum limit, then program control continues to step 610 and continues processing in the manner described above. If, however, it is determined during step 630 that the current buffer length is less than or equal to the minimum limit, then one or more of the oldest samples in the buffer are duplicated during step 640, to ensure that the buffer does not empty. Program control then continues to step 610 and continues processing in the manner described above.

It is to be understood that the embodiments and variations shown and described herein are merely illustrative of the principles of this invention and that various modifications may be implemented by those skilled in the art without departing from the scope and spirit of the invention.

We claim:

1. A receiver for a digital speech communication system, comprising:

a frame buffer for storing received frames of voice data, said frames being written to said buffer at a first rate;

means for correcting for frame erasure;

a speech decoder for converting said frames read from said frame buffer into blocks of speech samples, said frames being read from said buffer at said first rate;

a variable frame buffer positioned after said speech decoder for storing said blocks of speech samples, said blocks of speech samples being written to said variable frame buffer at said first rate; and a digital-to-analog converter for presenting said blocks of speech samples read from said variable frame buffer to a listener, said speech samples being read from said variable frame buffer at a second rate.

2. The receiver according to claim 1, wherein one or more of said individual speech samples are deleted from said variable frame buffer if said variable frame buffer is full.

3. The receiver according to claim 1, wherein one or more of said individual speech samples are copied into said variable frame buffer if said variable frame buffer is empty.

4. The receiver according to claim 1, further comprising a demultiplexer for separating said voice data from other information transmitted with said voice data.

5. The receiver according to claim 1, wherein said first and second rates are asynchronous.

6. The receiver according to claim 1, wherein the second rate is synchronized to the first rate.

7. The receiver according to claim 1, wherein said buffers are allowed to partially fill before being read.

8. A method for receiving frames of voice data in a digital communication system, said method comprising the steps of:

buffering said received frames of voice data, said frames being written to a first area of memory at a first rate;

correcting for frame erasure;

converting said frames read from said first area of memory into blocks of speech samples, said frames being read from said first area of memory at said first rate;

buffering for said blocks of speech samples in a second area of memory, said blocks of speech samples being written to said second area of memory at said first rate, said second buffering step being performed after said converting step, and converting said blocks of speech samples read from said second area of memory for presentation to a listener, said speech samples being read from said second area of memory at a second rate.

9. The method according to claim 8, wherein one or more of said individual speech samples are deleted from said second area of memory if said second area of memory is full.

10. The method according to claim 8, wherein one or more of said individual speech samples are copied into said second area of memory if said second area of memory is empty.

11. The method according to claim 8, further comprising the step of demultiplexing said voice data from other information transmitted with said voice data.

12. The method according to claim 8, wherein said first and second rates are asynchronous.

13. The method according to claim 8, wherein said second rate is synchronized to said first rate.

14. The method according to claim 8, further comprising the step of allowing said buffers to partially fill before being read.

15. A receiver for presenting received frames of voice data to a listener, comprising:

a speech decoder for converting said received frames into blocks of speech samples;

means for correcting for frame erasure;

a variable frame buffer positioned after said speech decoder for storing said blocks of speech samples, said blocks of speech samples being written to said variable frame buffer at a first rate extracted from said received frames; and a digital-to-analog converter for presenting said blocks of speech samples read from said variable frame buffer to said listener, said speech samples being read from said variable frame buffer at a different rate than said first rate.

16. The receiver according to claim 15, wherein one or more of said individual speech samples are deleted from said variable frame buffer if said variable frame buffer is full.

17. The receiver according to claim 15, wherein one or more of said individual speech samples are copied into said variable frame buffer if said variable frame buffer is empty.

18. The receiver according to claim 15, further comprising a demultiplexer for separating said voice data from other information transmitted with said voice data.

19. The receiver according to claim 15, wherein said first rate is extracted from said received signal.

20. The receiver according to claim 15, wherein said first and second rates are asynchronous.

21. The receiver according to claim 15, wherein said second rate is synchronized to said first rate.

* * * * *